US006215399B1

(12) United States Patent
Shpater

(10) Patent No.: US 6,215,399 B1
(45) Date of Patent: Apr. 10, 2001

(54) PASSIVE INFRARED MOTION DETECTOR AND METHOD

(75) Inventor: Pinhas Shpater, Laurent (CA)

(73) Assignee: Shmuel Hershkovitz, Haifa (IL)

( * ) Notice: Subject to any disclaimer, the term of this patent is extended or adjusted under 35 U.S.C. 154(b) by 0 days.

(21) Appl. No.: 08/967,165

(22) Filed: Nov. 10, 1997

(51) Int. Cl.[7] ..... G08B 13/193

(52) U.S. Cl. ..... 340/567; 250/340; 250/371; 250/395; 356/51; 356/256

(58) Field of Search ..... 340/567; 250/340, 250/371, 395; 356/51, 256

(56) References Cited

U.S. PATENT DOCUMENTS

| | | | | |
|---|---|---|---|---|
| 4,523,095 | * | 6/1985 | Keller-Steinbach | 250/349 |
| 4,614,938 | * | 9/1986 | Weitman | 340/567 |
| 4,697,081 | * | 9/1987 | Baker | 250/338 |
| 4,849,635 | * | 7/1989 | Sugimoto | 340/567 |
| 4,963,749 | * | 10/1990 | McMaster | 250/349 |
| 5,045,702 | * | 9/1991 | Mulleer | 340/567 |
| 5,473,311 | * | 12/1995 | Hoseit | 340/573 |
| 5,670,943 | * | 9/1997 | DiPoala et al. | 340/567 |
| 5,923,250 | * | 7/1999 | Pildner et al. | 340/567 |

FOREIGN PATENT DOCUMENTS

0624857A1 * 11/1994 (EP) .

* cited by examiner

*Primary Examiner*—Glen Swann
(74) *Attorney, Agent, or Firm*—Burns, Doane, Swecker & Mathis, LLP

(57) ABSTRACT

Zones of a passive infrared (PIR) motion detector lens are staggered at close range to provide for pet immunity. In a dual sensor, dual lens configuration, the sensor signal is acted on to generate an alarm only when the sensor signal is simultaneous, indicating that an infrared emitting object big enough to cross both staggered zones of a zone pair has been detected. To further enhance sensitivity and immunity to noise, two dual element PIR sensors are arranged in opposite polarity with their elements vertically parallel. The sensor output is simultaneous and of opposite polarity, and noise can be suppressed by blocking like-polarity signals.

22 Claims, 8 Drawing Sheets

PASSIVE INFRARED MOTION DETECTOR AND METHOD

FIELD OF THE INVENTION

The present invention relates to a passive infrared (PIR) motion detector apparatus and method. More specifically, the invention relates to such a motion detector in which pet immunity is provided by the beam design. The invention relates further to a dual PIR sensor motion detector in which the sensors have a simultaneous response with reduced false alarms by requiring a simultaneous response from both sensors to generate an alarm. The invention also relates to a dual PIR sensor motion detector in which the sensors have a simultaneous response with opposite polarity to prevent false alarms due to external interference such as RF noise.

BACKGROUND OF THE INVENTION

Conventional PIR motion detectors have difficulty with "false" alarms resulting from pets moving through detection zones at close range to the detectors. The level of IR radiation emitted by pets is sufficient at such close range to cause an alarm. Usually care is taken to mask such zones or to disable motion detectors where pets are found. Clearly, such total or partial disabling of the motion detection alarm system is not desirable, however, it is considered better to lower the quality of detection to preserve an acceptable low level of false alarms. Alternatively, pet immunity has been provided in the signal processing of the PIR sensor response signal by ignoring low level responses generated by pets and/or requiring more movement before generating an alarm. Such measures risk failing to detect human intruder motion by effectively lowering sensitivity.

Another approach to dealing with pet immunity in motion detectors has been special processing of detector signals, particularly in the case of dual technology detectors, which may be used to distinguish between pets and human intruders, as is disclosed in U.S. Pat. No. 5,473,311 to Hoseit. Such detectors are more complicated and more costly, both at the sensor level and the signal analysis level.

Dual channel PIR motion detectors are known in the art, as for example in U.S. Pat. No. 4,614,938 to Weitman and U.S. Pat. No. 4,963,749 to McMaster. It is known to use a single quad PIR sensor having four IR sensitive elements as well as two PIR sensor devices each having a pair of IR sensitive elements. The advantage of two channels over one is simply greater reliability of sensor output signal. An alarm signal is thus only generated when both channels indicate motion. Preventing false alarms and ensuring detection is of great importance to PIR motion detectors used in the security industry.

In U.S. Pat. No. 4,697,081 to Baker, a quad element sensor is disclosed in which interdigitated IR sensitive elements are provided. By this arrangement, both IR elements respond to infrared radiation collected by the lens, and the risk of false triggering is reduced. In U.S. Pat. No. 5,045,702 to Mulleer, a single channel detector is disclosed in which the sensor element configurations include a diamond pattern with opposed pairs of IR sensitive elements of opposite polarization connected in series. Such motion detectors typically employ a single lens to direct infrared radiation onto the single quad or multi-element sensor.

It is also known in the art to provide dual lens and dual sensor motion detectors. Such systems conventionally have a single housing with two lenses mounted one above the other. Each sensor receives radiation from one corresponding lens. The optical arrangement is such that infrared radiation from a person entering a detection zone will not be simultaneously received by both sensors, but rather sequentially. The response from the sensors is thus separated in time, and has a same polarity since the sensor IR sensitive elements of the two sensors are aligned parallel with like polarity. Such a dual channel motion detector can generate an alarm accurately when the response in both channels is similar and separated in time by the expected amount.

SUMMARY OF THE INVENTION

It is a first object of the invention to provide a PIR motion detector having improved reliability of detection with pet immunity. Accordingly, there is provided a PIR motion detector having a beam design facilitating descrimination of pets from humans. According to one aspect of the invention, there is provided a PIR motion detector having two sensors and two corresponding infrared lenses in which at close range the lenses will not direct infrared radiation simultaneously from small infrared emitting objects onto both sensors, and corresponding detection zones of the lenses at a far range substantially overlap. The detection zones are staggered so that a pet crossing the zones at the same range will generate a signal in each of the sensors alternatingly. The long separation between consecutive motion signals in the same sensor, as well as the generation of motion signals in alternating sensors, allow the easy discrimination of pet-generated motion signals and suppression of false alarms.

The invention also provides a method and apparatus of detecting an intruder in a PIR sensor motion detector having a single sensor and lens in which the zones are staggered in height to prevent alarm signal generation when pets cross only alternate zones at close range.

It is a second object of the invention to provide a dual PIR motion detector in which the sensors and lenses are vertically aligned to have a simultaneous response. When the response from the two detectors is not simultaneous, an alarm signal is not generated, and thus false alarms are avoided. A "simultaneous" response requires accurate alignment of the two sensors and lenses, which can be provided by mounting the lenses and sensors in the same housing. Preferably, the lenses are formed on the same fresnel lens sheet to avoid any minor misalignment between the two lenses.

It is a third object of the invention to provide a dual PIR motion detector having improved immunity to electromagnetic interference, such as RFI. Preferably, two sensors and two corresponding infrared lenses are provided in which the sensors have a simultaneous, opposite polarity response to infrared radiation, while having a same polarity response to RFI. By arranging two PIR sensors with sensor elements vertically parallel and in opposite polarity, the sensors also remain sensitive to far objects moving through part of detection zones, while the reverse polarity of motion signals allow for easy discrimination of interference noise signals.

BRIEF DESCRIPTION OF THE DRAWINGS

The invention will be better understood by way of the following description of a preferred embodiment of the invention with reference to the appended drawings, in which.

DETAILED DESCRIPTION OF THE PREFERRED EMBODIMENT

Figure 1:
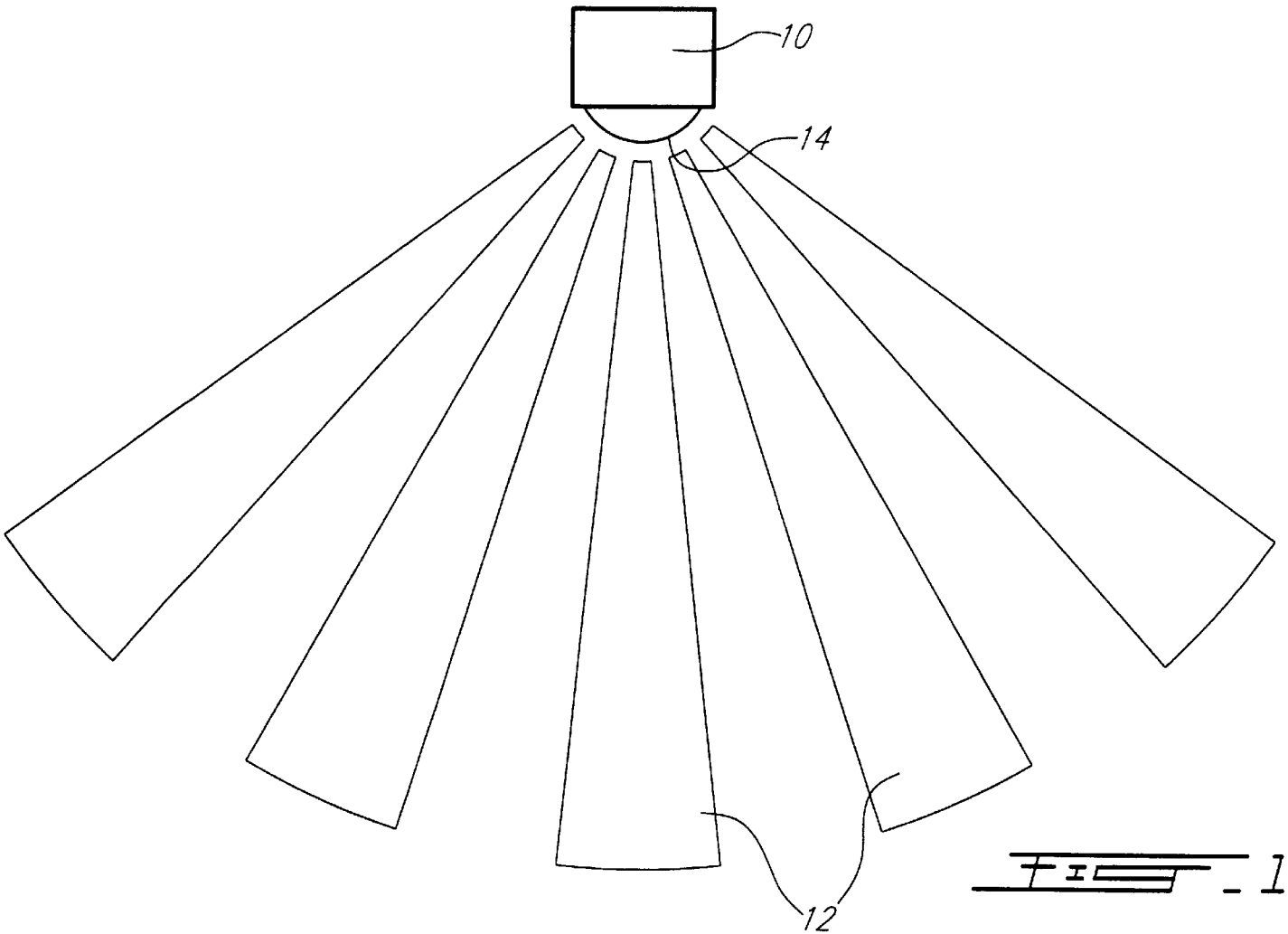
FIG. 1 (PRIOR ART)
FIG. 1 is a top view of a prior art detection zone configuration.

As shown in the plan view of FIG. 1, it is conventionally well known in PIR motion detectors to use an infrared lens, typically of the fresnel type provided on a molded sheet of plastic, to direct infrared radiation from an area to be monitored onto a PIR sensor. The lens 14 divides the area into zones 12, such that IR light from the zones reaches the sensor while light from outside the zones 12 is blocked. An intruder moving across the zones 12 will result in sudden changes in the amount of IR light detected, and thus provide signal for an alarm. As shown in FIG. 1, a typical plan view shows the zones divided in a regular fan-like configuration. The detector 10 is typically mounted about 2 m high on a wall, and the zone are arranged in various directions both in azimuth and elevation.

Figure 2:
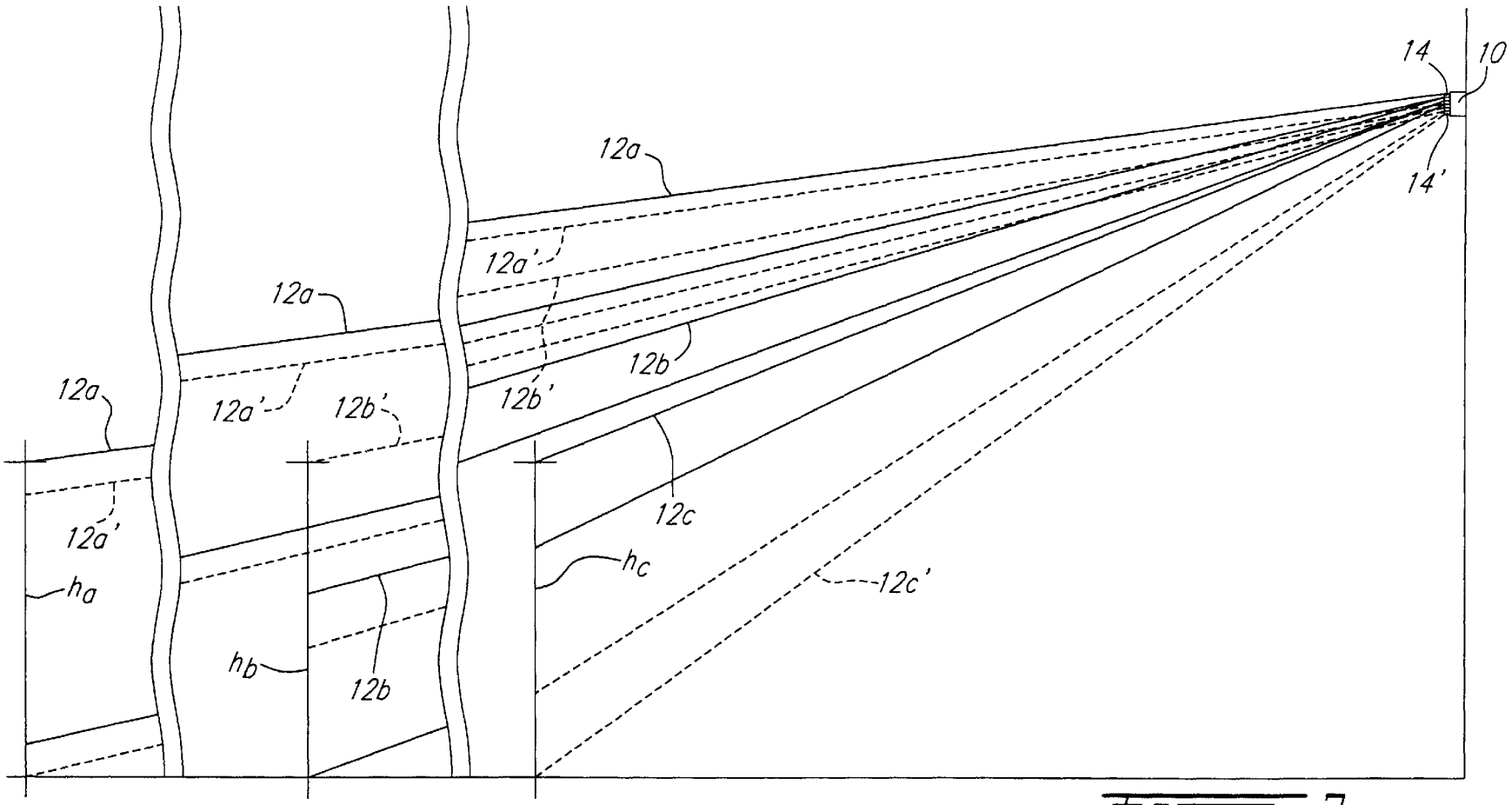
FIG. 2 is a side view of the detection zone configuration of the invention showing zone separation at close range and substantially parallel zones overlapping at far range.

In FIG. 2, the illustration of the zones viewed from the side shows a simplified arrangement with three rows of zones, and thus three elevations of zone orientation for three ranges, eg. 3 m, 6 m, and 9 m. Zone 12*a* of lens 14 is a long range zone, while zone 12*c*' is a close range zone of lens 14'.

Figure 8:
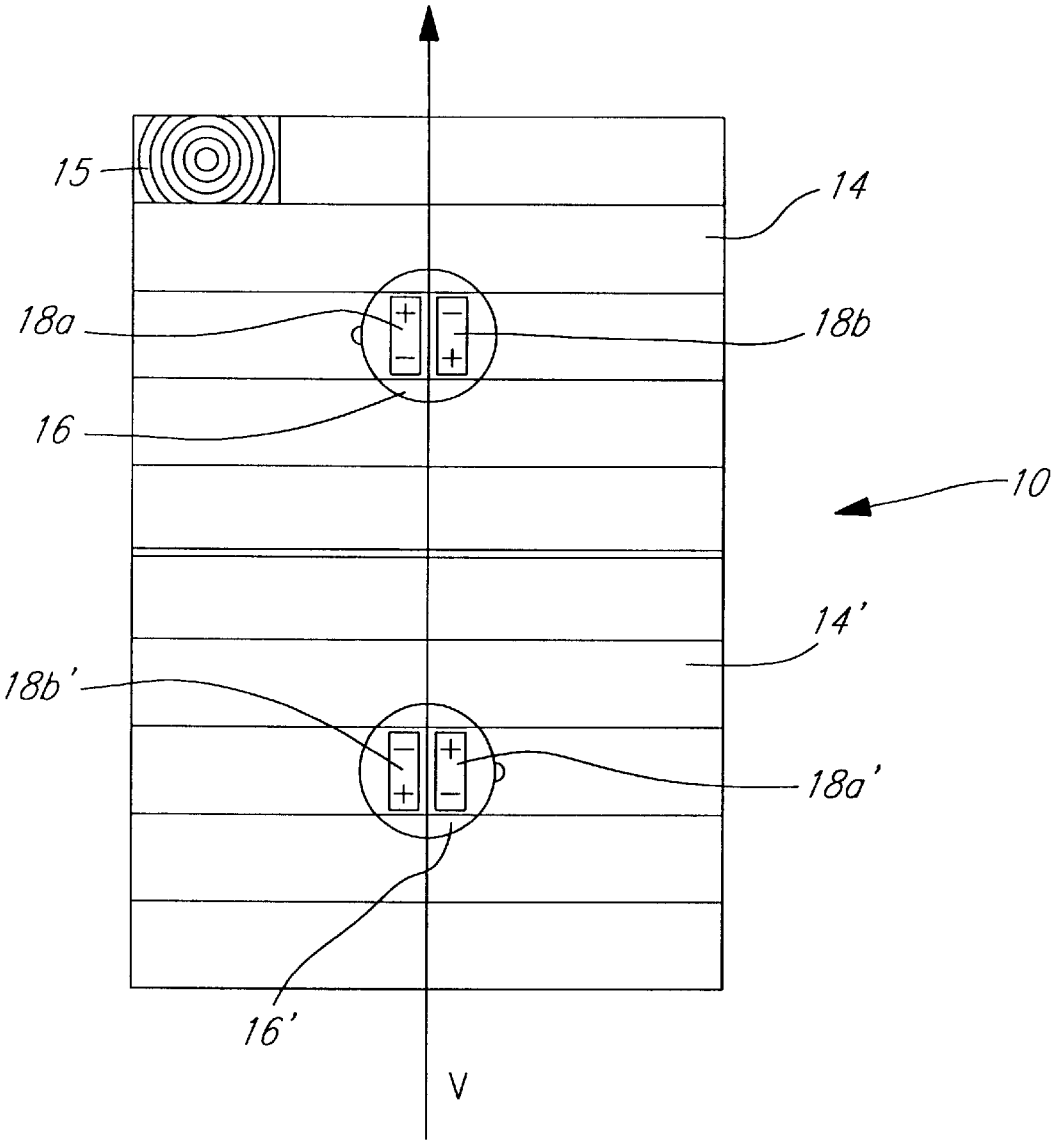
FIG. 8 is a schematic diagram of a lens and sensor layout for a dual lens, dual sensor PIR motion detector according to the preferred embodiment.

In the preferred embodiment according to the present invention, the zones of the two lenses 14 and 14' are arranged to have corresponding zones 12 sharing approximately the same shape, azimuth direction and solid angle to give substantially the same response characteristics. The lenses 14 and 14' are preferably provided on a single sheet as shown in FIG. 8 to ensure proper vertical alignment. However, the elevation of the corresponding zones is different. At close range, the elevation of the zones 12*c* and 12*c*' is made different so as to separate the zones.

By separating the zones, a dog or cat walking on the floor at the same range will not move into or out of both zones 12*c* and 12*c*' simultaneously, as is required to generate an alarm. Likewise, in the small overlapped area between zones 12*b* and 12*b*', the effect of a small pet moving in or out of the overlapped area will not generate an alarm, since the distance is greater and only a portion of each zone 12*b*, 12*b*' receives the IR light emitted. In the case of zones 12*a* and 12*a*', only large objects creating large IR radiation level disturbances will be detected since the range is far. The zones 12*a* and 12*a*' overlap as much as possible. The height of each corresponding zone pair is shown as $h_a$, $h_b$ and $h_c$. The height is shown as a vertical height measured from the point at which a bottom of the lower zone of the zone pair intersects the floor and the top of the upper zone of the zone pair, however, the height may also be measured in the direction tangential to the zone and in a vertical plane. While not essential, it is preferred that this height be substantially consistent and be approximately 80–120 cm (typically 50 cm to 150 cm in range).

Figure 3:
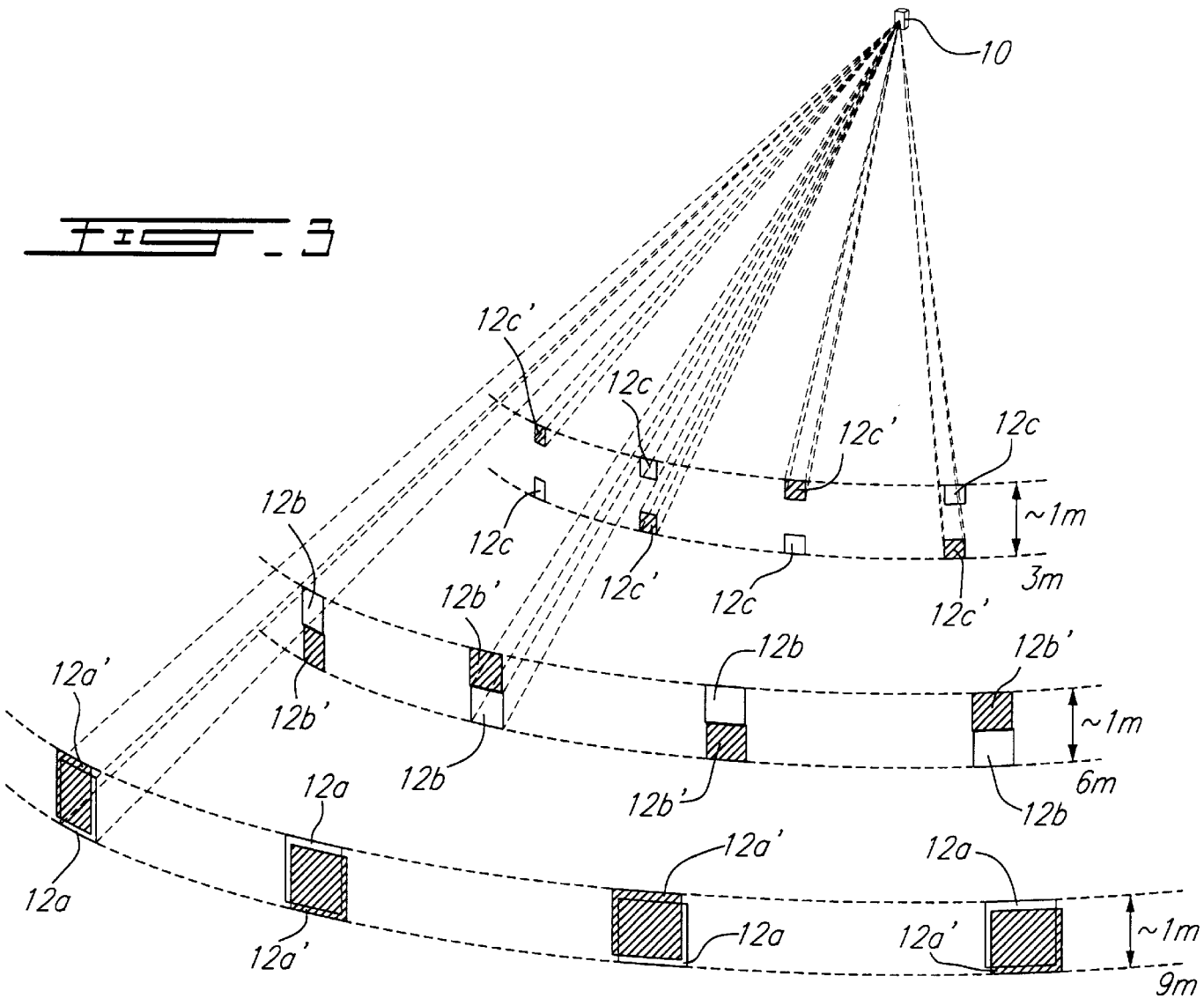
FIG. 3 is a perspective view of the detection zone cross section of the invention at three different ranges showing alternating zone separation at close range according to the preferred embodiment.

As shown in FIG. 3, the zones 12*b*/12*b*' and 12/12*c*' at close range alternate. By staggering the zones as shown, a pet walking across the zones will be "seen" alternatingly by lenses 14 and 14'. An infrared emitting object is simply too short to be "seen" by both zones 12 and 12' simultaneously. By detecting motion from alternating sensors suppression of an alarm is made easy. Furthermore, error detection circuitry in the detector can be set to generate a trouble alarm when one sensor generates much more signal than the other sensor, or vice versa, since both sensors should be equally active.

Figure 4A:
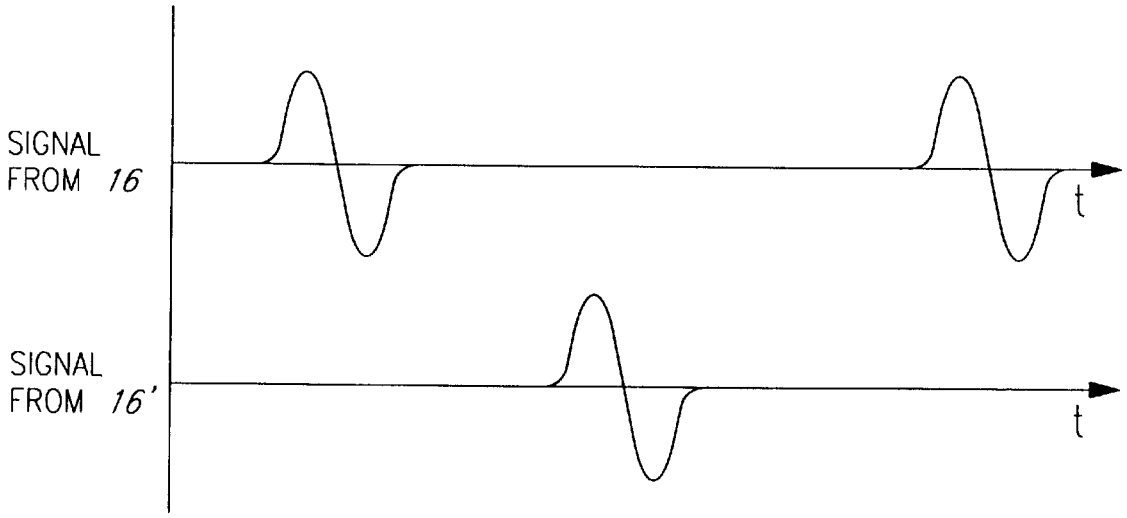
FIG. 4*a* is a motion signal diagram illustrating the motion signals generated by a pet moving at a close range.
Figure 4B:
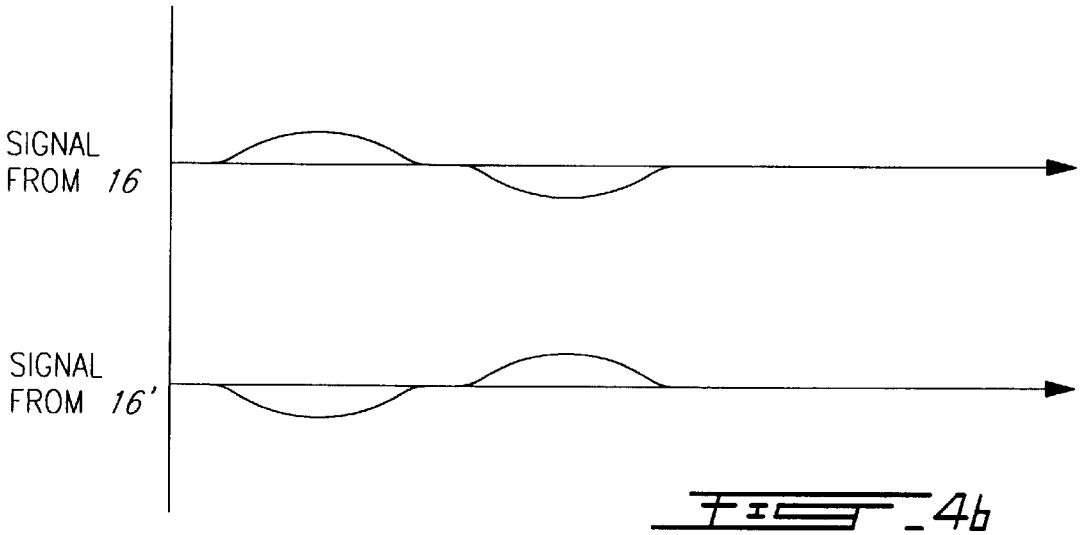
FIG. 4*b* is a motion signal diagram illustrating the motion signals generated by a pet moving at a far range.

As shown in FIG. 4*a*, a pet moving through the zones at close range generates a significant signal alternatingly in each channel. At a far range, the pet moves through both zones simultaneously, however, the signal generated is weak and is characteristic of a small object moving through a zone at a far range, i.e. slowly. The equivalent diagram to FIG. 4*a* for a human would be for the same, opposite polarity signal to appear from sensor 16 and 16' simultaneously, and thus three times in the time period shown.

It will be apparent to those skilled in the art of lens design how to create lenses 14 and 14' which result in different elevation directions to produce zone separation and staggering for close range zones in accordance with the present invention.

Figure 5:
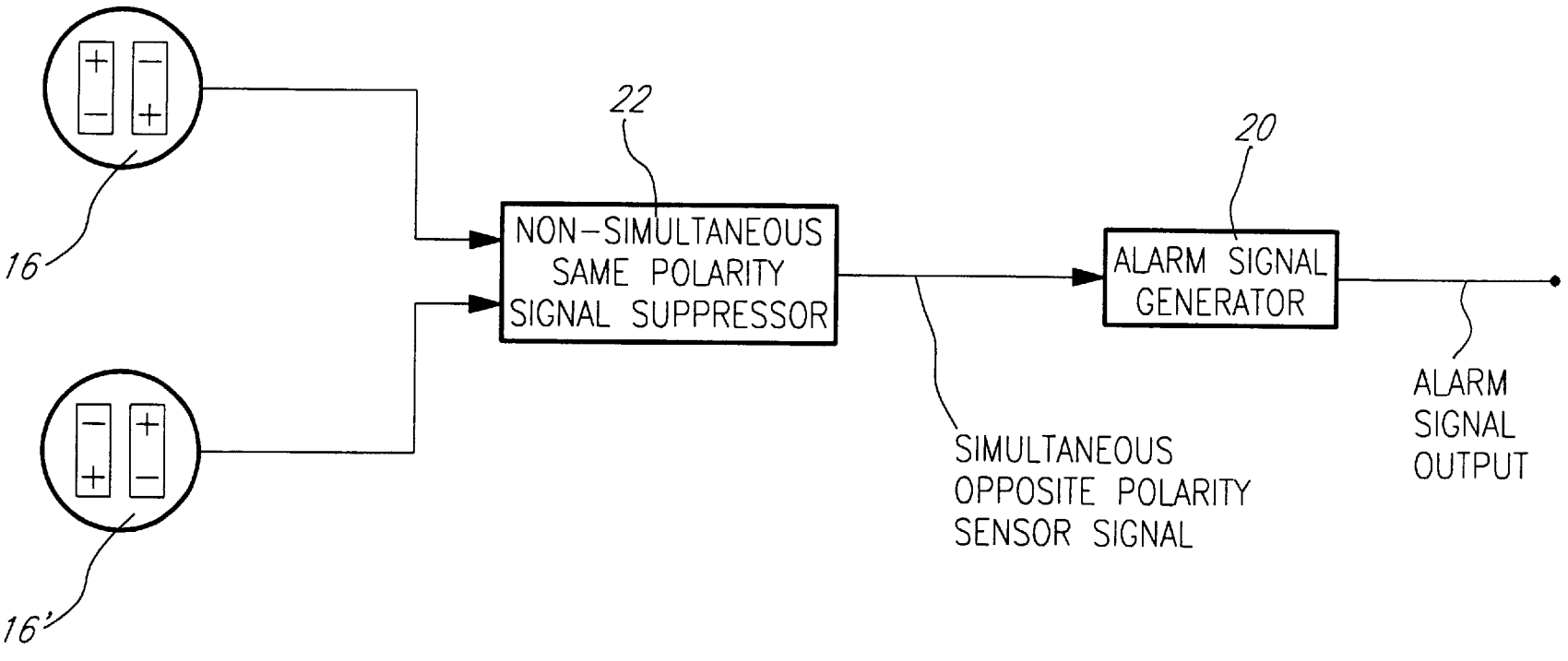
FIG. 5 is a schematic block diagram of the preferred embodiment.

As shown in FIG. 5, the motion detector circuit comprises a signal suppressor 22 connected to both PIR sensors 16 and 16'. The sensors are arranged to be in opposite polarity. The suppressor 22 allows one of the signals from the sensors 16,16' to pass through to its output if the sensor signals are in opposite polarity and if an absolute value of the sum of the sensor signals is less than a small threshold, i.e. the two sensor signals must be simultaneous. The alarm signal generator 20 is a single channel sensor signal analyzer. Since the signal it analyzes is the output of circuit 22, and thus the product of two sensors operating simultaneously with opposite polarity, there is greater confidence that the sensor signal is the result of valid intruder motion. Accordingly, the alarm signal generator 20 may employ less rigorous analysis of the signal, and may set less stringent standards than in conventional PIR motion detectors to generate an alarm signal.

Figure 11:
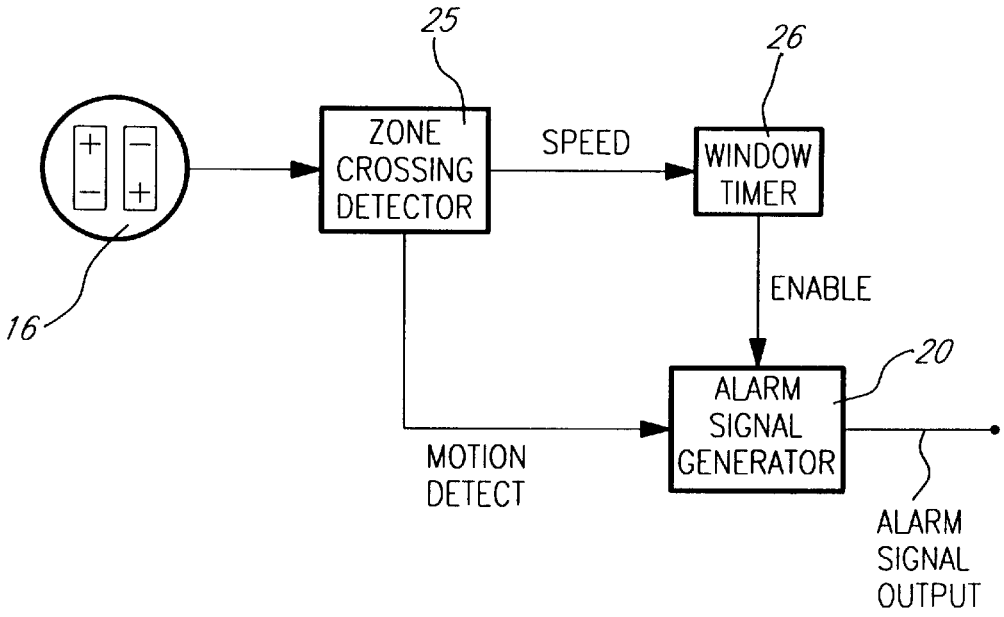
FIG. 11 is a block diagram of a single sensor motion detector circuit for processing signals when a staggered zone lens is used for pet immunity.

The present invention also provides for a single sensor, single lens PIR motion detector, as shown in FIG. 11. The single lens is configured like lens 14 or 14', and as shown in FIG. 3, the zones are staggered, eg. like zones 12*b*/12*b*' and 12*c*/12*c*'. The single sensor output signal when a pet moves across the zones at close range may look like the signal from sensor 16 shown in FIG. 4*a*, i.e. two separated signals. A human moving across the same zones would result in a signal being generated between the two separated signals. Even without the advantage of the dual lens and dual sensor, pet discrimination can be easilily done using the staggered zone configuration of lens 14.

The alarm signal generator 20 for the single sensor detector requires two signals (i.e. two zone crossings) to generate an alarm with pet immunity. Two closely spaced in time signals are required to generate an alarm. A large time gap between signals is indicative of pet motion and is rejected from generating an alarm. The time gap between signals may be a fixed time period, but preferably, the alarm signal generator has a zone crossing detector 25 that analyzes the first sensor signal to determine its width, i.e. the speed of motion. Motion through a near zone will generate a more compressed signal than a far zone. Similarly, fast motion through a zone will generate a shorter (higher amplitude) signal than slow motion. The allowable time gap between signals can be set to an amount times the signal width (eg. the next signal must start within 1.5 times the signal width of the previous signal after the end of the previous signal), so that close or fast pet motion does not appear as two close signals and so that slow human motion at far range does not appear as two signals resulting from pet motion. The speed signal is generated after motion is detected across a zone by detector 25, and the timer 26 generates an enable signal for generator 20. The signal analyzer operates to detect the crossing of the first zone. The signal width being indicative of the speed of motion, namely short pulses mean fast motion and long pulses mean slow motion, is used to set the window or allowable time gap between the first signal and the second signal. If the second signal comes within the window, then the motion detect signal is generated while the generator is enabled by the timer, and an alarm signal output is generated. If the second signal comes after the window, then the enable signal is no longer present and no alrm is generated. The late second signal causes detector 25 to set a new speed signal, and the generator 20 is enabled for another window. Alternatively, an alarm signal can be generated if an energy level of the sensor signal over a predetermined window time period is greater than a predetermined threshold. Without detecting and measuring the time gap between signals, a predetermined width window can be used, and when the signal energy inside the window is above an alarm threshold, the alarm signal can be generated.

Figure 6:
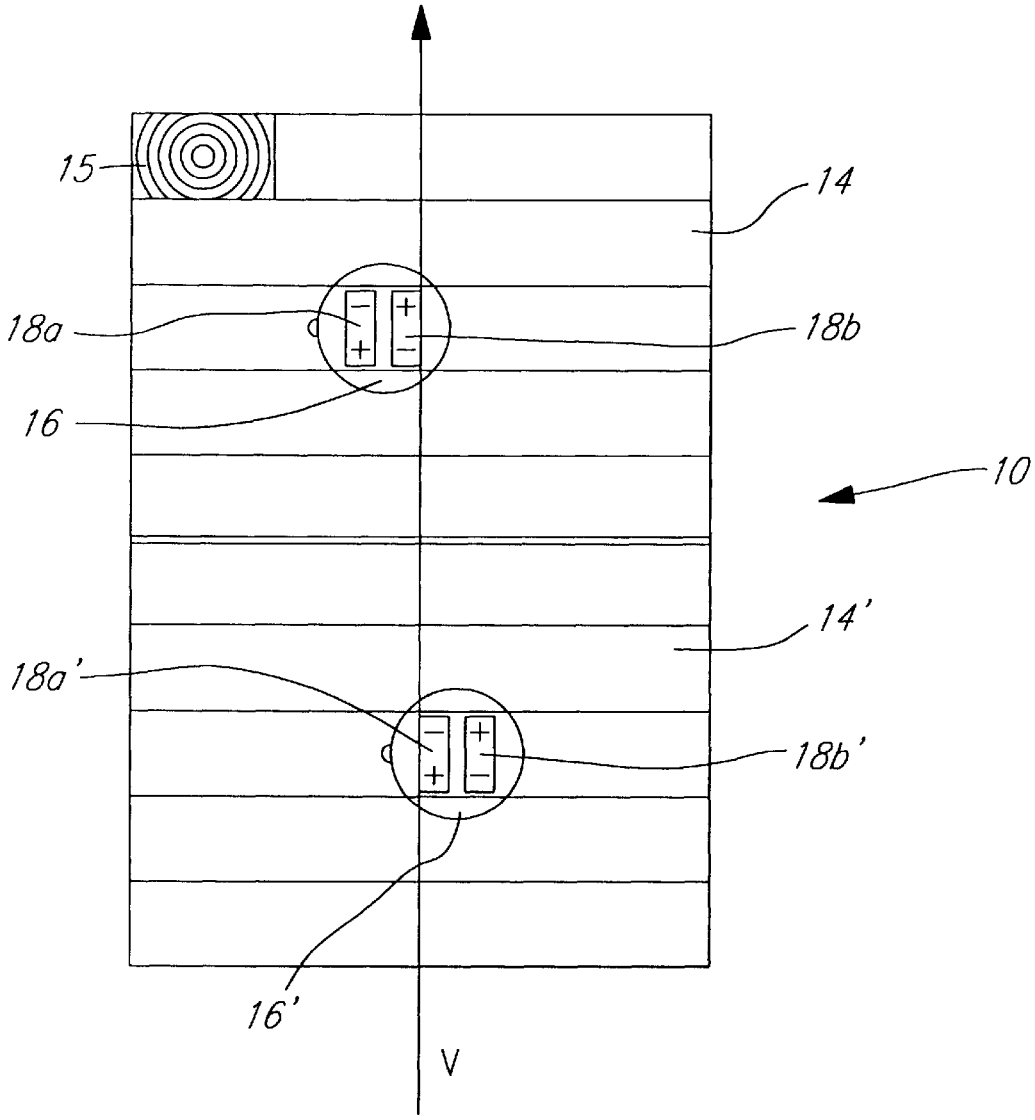
FIG. 6 (PRIOR ART)
FIG. 6 is a schematic diagram of a lens and sensor layout for a dual lens, dual sensor PIR motion detector according to the prior art.
Figure 7:
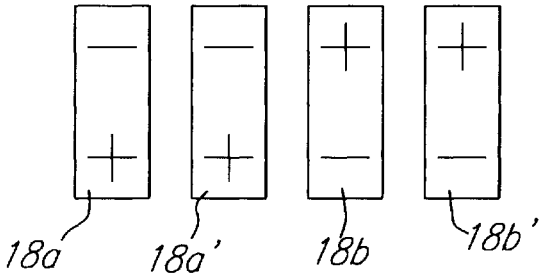
FIG. 7 (PRIOR ART)
FIG. 7 is a schematic diagram of the equivalent sequential four element sensor resulting from the arrangement illustrated in FIG. 5 according to the prior art.

In FIG. 6, there is shown a dual lens dual sensor motion detector according to the prior art. The pair of lenses 14 and 14' are arranged one above the other, aligned with respect to a vertical axis V. Each zone is viewed by a lens element 15, shown only for the upper right hand corner zone only, for the sake of clarity in the drawings. The sensors 16 and 16' are arranged offset to opposite sides of the vertical axis by a small amount equivalent to the width of the IR radiation sensitive elements 18 (FIG. 6 shows the offset much exaggerated for the purposes of illustration). The net result of the offset and the lens arrangement can be compared to a four element quad sensor receiving IR radiation from a single lens, as shown in FIG. 7. An object moving into a zone will cause like polarity signals to be generated by the sensors 16 and 16', although the signals will be slightly delayed due to the sequential geometry of the arrangement.

In the prior art, it is also known to provide the sensors 16 and 16' aligned on the axis V and to provide the lenses 14 and 14' offset to achieve the same net result as shown in FIG. 7.

Figure 9:
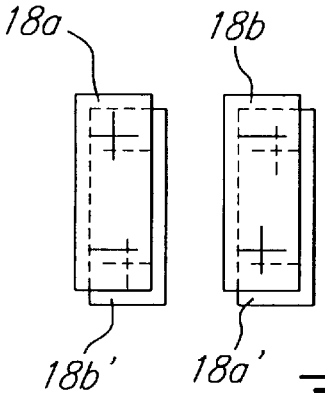
FIG. 9 is a schematic diagram of the equivalent simultaneous, superposed four element sensor resulting from the arrangement illustrated in FIG. 8 according to the preferred embodiment.
Figure 10:
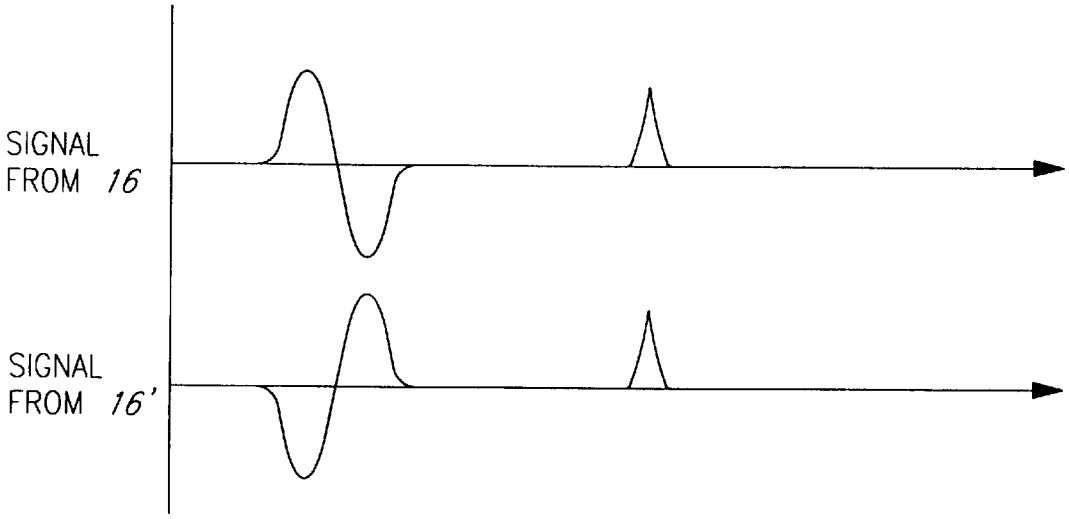
FIG. 10 is a signal diagram illustrating the opposed polarity output signals from the motion detector according to the preferred embodiment.

In the preferred embodiment, the sensors 16 and 16' are Heimann LHI958 pyroelectric sensors. The sensor elements 18*a* and 18*b* of sensor 16 are arranged vertically and parallel to elements 18*a'* and 18*b'* of sensor 16', as shown in FIG. 8. The polarity of the elements 18 are opposite, such that 18*a* is on an opposite side of the axis V from 18*a'*. The lenses 14 and 14' direct IR light onto the sensors to result in substantially the same response, with the exception of the separation of the close range zones as described above. The result is a simultaneous, reverse polarity response of the two sensors 16 and 16'. As shown in FIG. 9, the result of the arrangement would be the equivalent of two pairs of superposed elements 18 receiving IR light from the same lens. Of course, the equivalent quad arrangement is not feasible. The arrangement according to the invention allows for objects moving through a lower part of far range zones to be seen by at least part of the sensor elements while still generating opposite polarity signals As shown in FIG. 10, the sensor signals in the preferred embodiment have substantially a same phase, but opposite polarity. Background noise, such as spikes, will have a same polarity. Such spike signals will be suppressed by suppressor 22.

Although the invention has been described above with reference to a preferred embodiment, it is to be understood that the above description is intended merely to illustrate the invention and not to limit the scope of the invention as defined in the appended claims.

What is claimed is:

1. A method of detecting an intruder using a dual PIR sensor motion detector comprising the steps of:

collecting infrared radiation from first and second arrays of detection zones, said zones each having a predetermined elevation direction with respect to a vertical direction for reaching a predetermined range and having a predetermined azimuth plane with respect to a horizontal direction, wherein:

each one of said zones in said first array corresponds substantially to a respective one of said zones in said second array;

said corresponding zones have substantially the same shape, solid angle and azimuth direction;

ones of said corresponding zones reaching a close range have different said elevation directions to provide zone separation, whereby short infrared emitting objects only cross one of said corresponding zones of said first and second arrays:

ones of said corresponding zones reaching a far range have substantially the same said elevation direction to provide almost no zone separation, whereby small animals crossing said first and second array of zones at a close range do not result in said alarm signal being generated;

detecting said collected radiation using first and second PIR sensors, associated respectively with said first and second arrays, said first PIR sensor outputting a first sensor signal and said second PIR sensor outputting a second sensor signal; and generating an alarm signal when both said first and second sensor signals simultaneously indicate intruder motion across said corresponding zones, whereby false alarms are reduced.

2. The method as claime in claim 1, wherein said step of collecting comprises providing a single sheet lens and said step of detecting comprises providing said sensors in a common housing supporting said lens.

3.The method as claimed in claim 2, wherein:

said first and said second arrays of zones are staggered at close range such that short infrared emitting objects crossing said zones at a fixed close range will enter only one of said corresponding zones of alternate ones of said first and second arrays;

whereby small animals crossing said first and second array of zones at a close range do no result in said alarm signal being generated.

4. The method as claimed in claim 1, wherein:

said first and said second arrays of zones are staggered at close range such that short infrared emitting objects crossing said zones at a fixed close range will enter only one of said corresponding zones of alternate ones of said first and second arrays;

whereby small animals crossing said first and second array of zones at a close range do not result in said alarm signal being generated.

5. The method as claimed in claim 1, wherein said step of generating comprises suppressing said alarm signal when radiation detected using said first PIR sensor is not substantially simultaneous with radiation detected using said second PIR sensor.

6. An infrared intrusion detector comprising:

first and second PIR sensors arranged vertically one above the other;

first and second lenses arranged vertically one above the other, said first and said second lenses for directing infrared radiation from a first and a second array of zones respectively onto said first and said second sensors respectively, each one of said zones having a predetermined elevation direction with respect to a vertical direction for reaching a predetermined range and having a predetermined azimuth direction, wherein:

each one of said zones in said first array corresponds substantially to a respective one of said zones in said second array;

said corresponding zones have substantially the same shape, solid angle and said azimuth direction, whereby infrared emitting objects cross said corresponding zones simultaneously;

ones of said corresponding zones reaching a close range having different said elevation directions to provide zone separation, whereby short infrared emitting objects only cross one of said corresponding zones of said first and second arrays; and ones of said corresponding zones reaching a far range having substantially the same said elevation direction to provide almost no zone separation, whereby said sensors operate simultaneously.

7. The detector as claimed in claim 6, wherein:

said first and said second arrays of zones are staggered at close range such that short infrared emitting objects crossing said zones at close range will cross only one of said corresponding zones of alternate ones of said first and second arrays, whereby at close range said lenses will not direct infrared radiation from small infrared emitting objects onto both said sensors, and said corresponding zones at a far range substantially overlap.

8. The detector as claimed in claim 7, further comprising alarm generating means connected to said sensors for generating an alarm signal, said generating means suppressing said alarm signal when a response of said sensors is indicative of non-simultaneous detection of intruder motion by said PIR sensors, such as occurs at a fixed close range.

9. The detector as claimed in claim 7, wherein said zone separation provides a substantially common height between a bottom of said zones in one of said arrays and a top of said corresponding zones in another of said arrays.

10. The detector as claimed in claim 9, wherein said common height is approximately 80 cm.

11. The detector as claimed in claim 7, wherein said sensors are arranged along a common axis next to one another, said sensors each generating an output signal and having two oppositely polarized sensing elements, said sensors being arranged with said sensing elements oriented vertically parallel and in an opposite direction, and said lenses are arranged along said axis, whereby said sensors have a simultaneous, reverse polarity response to motion of infrared emitting objects across a field of view of said lenses.

12. The detector as claimed in claim 11, further comprising means for suppressing an alarm signal when said output signals from said sensors are simultaneously of like polarity and waveform, whereby RFI noise is canceled.

13. An infrared intrusion detector comprising:

first and second PIR sensors arranged along a common vertical axis next to one another, said sensors each generating an output signal and having two oppositely polarized sensing elements, said sensors being arranged with said sensing elements oriented vertically parallel and in an opposite direction; and a pair of substantially similar lenses arranged substantially side by side along said axis, said first and said second lenses for directing infrared radiation onto said first and said second sensors respectively, whereby said sensors have a simultaneous, reverse polarity response to motion of infrared emitting objects across a field of view of said lenses.

14. The detector as claimed in claim 13, further comprising means for suppressing an alarm signal when said output signals from said sensors are simultaneously of like polarity and waveform, whereby RFI noise is canceled.

15. A method of detecting an intruder using a PIR motion detector comprising the steps of:

collecting infrared radiation from an array of detection zones, said zones each having a predetermined elevation direction with respect to a vertical direction for reaching a predetermined range and having a predetermined azimuth plane with respect to a horizontal direction, wherein:

ones of said zones reaching a close range have a different said elevation direction from neighboring ones of said zones at a same close range to provide zone staggering, whereby short infrared emitting objects only cross alternate ones of said zones when moving at said same close range; and ones of said zones reaching a far range have substantially the same said elevation direction to provide almost no zone staggering;

detecting said collected radiation using a PIR sensor to produce a sensor signal; and generating an alarm signal when said sensor signal indicates intruder motion across at least two neighboring ones of said zones, whereby small animals crossing said array of zones at close range generate PIR sensor signal from crossing every other zone and do not result in said alarm signal being generated.

16. The method as claimed in claim 15, wherein said step of generating comprises generating an alarm signal if an energy level of said sensor signal over a predetermined window time period is greater than a predetermined threshold.

17. The method as claimed in claim 15, wherein said step of generating comprises generating an alarm signal if said sensor signal indicates motion across one of said zones followed by motion across another of said zones within a predetermined time period.

18. The method as claimed in claim 17, wherein said predetermined time period is a predetermined amount times a pulse width of said sensor signal indicating motion across said one of said zones.

19. An infrared intrusion detector comprising:

a PIR sensor generating a sensor signal;

a lens for directing infrared radiation from an array of zones onto said sensor, each one of said zones having a predetermined elevation direction with respect to a vertical direction for reaching a predetermined range and having a predetermined azimuth plane with respect to a horizontal direction, wherein:

ones of said zones reaching a close range have different said elevation directions from neighboring ones of said zones reaching said same close range to provide zone staggering, whereby short infrared emitting objects only cross alternate ones of said zones when moving at said same close range; and ones of said zones reaching a far range have substantially the same said elevation direction to provide almost no zone staggering;

whereby small animals crossing said array of zones at a close range generate PIR sensor signal from crossing every other zone and do not result in said alarm signal being generated.

20. The detector as claimed in claim 19, wherein a distance between a bottom of one of said zones and a top of a neighboring one of said zones at said same close range is a substantially common height.

21. The detector as claimed in claim 20, wherein said common height is approximately 80 cm.

22. The detector as claimed in claim 19, further comprising sensor signal analyzing means for generating an alarm signal in response to said sensor signal when said sensor signal indicates crossing of two neighboring zones and for suppressing an alarm signal when said sensor signal indicates crossing of a zone and missing a neighboring zone.

* * * * *